United States Patent [19]

Burr

[11] 3,991,687

[45] Nov. 16, 1976

[54] TABLE WITH FOLDABLE LEGS

[75] Inventor: Alan C. Burr, East Norwalk, Conn.

[73] Assignee: Howe Furniture Corpoation, New York, N.Y.

[22] Filed: Sept. 8, 1975

[21] Appl. No.: 611,132

[52] U.S. Cl. ..... 108/132
[51] Int. Cl.[2] ..... A47B 3/00
[58] Field of Search ..... 108/129–133; 248/188.6, 439

[56] References Cited

UNITED STATES PATENTS

| | | | |
|---|---|---|---|
| 2,448,360 | 8/1948 | DeSaussure | 108/132 |
| 3,028,205 | 4/1962 | Howe | 108/130 |
| 3,093,095 | 6/1963 | Howe et al | 108/131 |

*Primary Examiner*—James C. Mitchell
*Attorney, Agent, or Firm*—Buckles and Bramblett

[57] ABSTRACT

A flat top table has opposed pairs of legs disposed in spaced relation from the periphery of the table top when in their extended upright positions. Each pair of legs is mounted on a rigid cross bar pivotally supported on a first axis of a frame secured to the underside of the table top. Rotatable handle means mounted on said frame and rotatable about a second pivotal axis are coupled to the legs at the first pivotal axis by an eccentric linkage whereby the legs are locked in either their upright position, or in a folded position at ninety degrees thereto, whenever the handle means is rotated beyond the pivotal center of said eccentric linkage. The foregoing abstract is not to be taken either as a complete exposition or as a limitation of the present invention. In order to understand the full nature and extent of the technical disclosure of this application, reference must be had to the following detailed description and the accompanying drawings as well as to the claims.

9 Claims, 9 Drawing Figures

11
13
16
18
20
22
30
31
32'
36
37
38

TABLE WITH FOLDABLE LEGS

BACKGROUND OF THE INVENTION

The invention relates to flat top tables rigidly supported by a plurality of legs disposed about the periphery of the table top, with concealed mechanism whereby opposite pairs of legs may be compactly folded adjacent and parallel to the underside of the table. An essential feature of the invention resides in a simple but effective leg locking mechanism on the underside of the table top which ridigly secures and holds opposite pairs of legs in either their unfolded upright position, whereby the table is solidly supported, or in their compact folded condition whereby the table may be stored in a minimum of space.

OBJECTS OF THE INVENTION

A principal object of the invention is to provide an improved folding table construction wherein the table has all of the characteristics, including the esthetic appearance and rigid support, of a similar non-folding table.

Another object of the invention is to provide such a table with means whereby pairs of legs may be quickly and easily unlocked from their rigid upright positions and folded into compact parallel relation to the underside of the table top, for convenient table storage.

A further object of the invention is to provide improved means in such a table construction for effectively locking the table legs in their folded position, as well as for locking the legs in their unfolded position.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings, in which:

DETAILED DESCRIPTION

Figure 1:
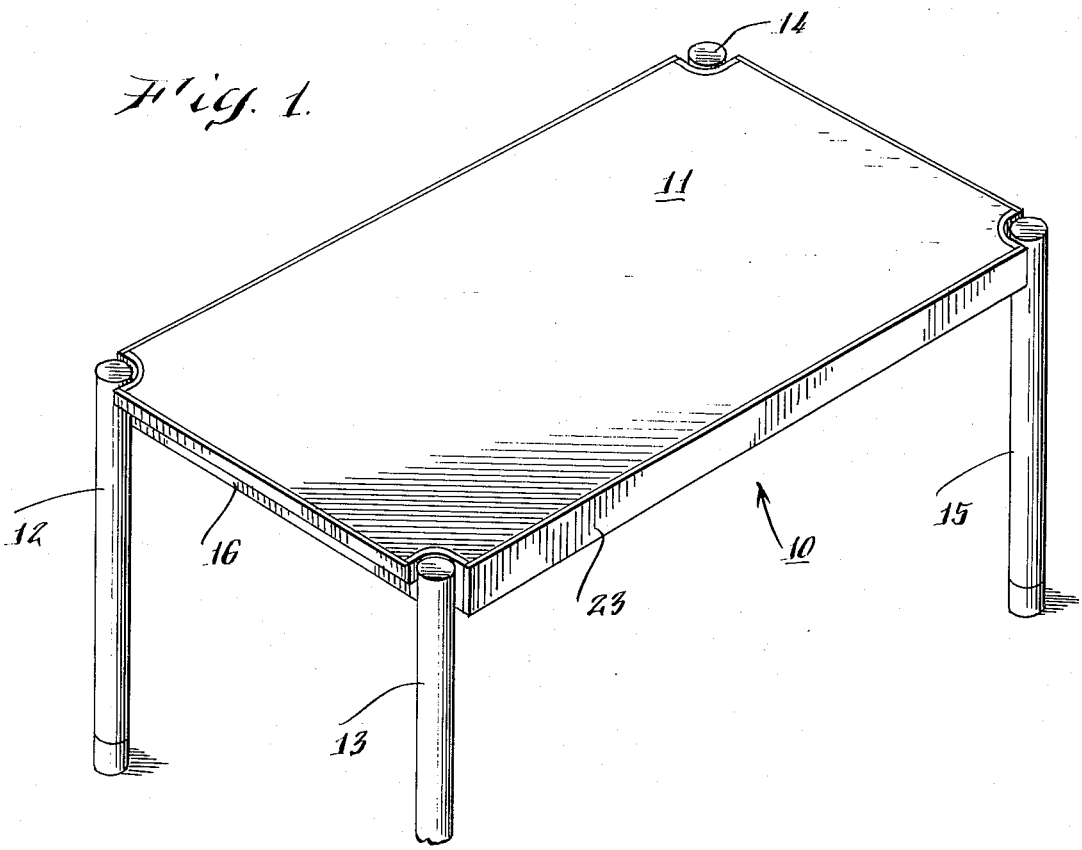
FIG. 1 is a perspective view of a table embodying the invention.

Referring first to FIG. 1 of the drawings, the invention comprises a table indicated generally at 10, having a flat top 11 supported by opposed pairs of legs 12–13 and 14–15 located at the four corners of the table top 11. For purposes of esthetic design the legs 12–13 and 14–15 are mounted in a manner to present their upper ends in a plane flush with the plane of table top 11, and arcuately spaced from the arcuately indented corners of table top 11. The method and structure for achieving this form of support are the subject of a copending U.S. patent application Ser. No. 611,131 filed concurrently herewith. The esthetics of this construction, which creates the visual impression of a free floating table top, are the subject of a separate copending design patent application. The desire to create this appearance gives rise to certain mechanical problems in devising leg folding and locking mechanisms which are the subject of the present application.

Figure 2:
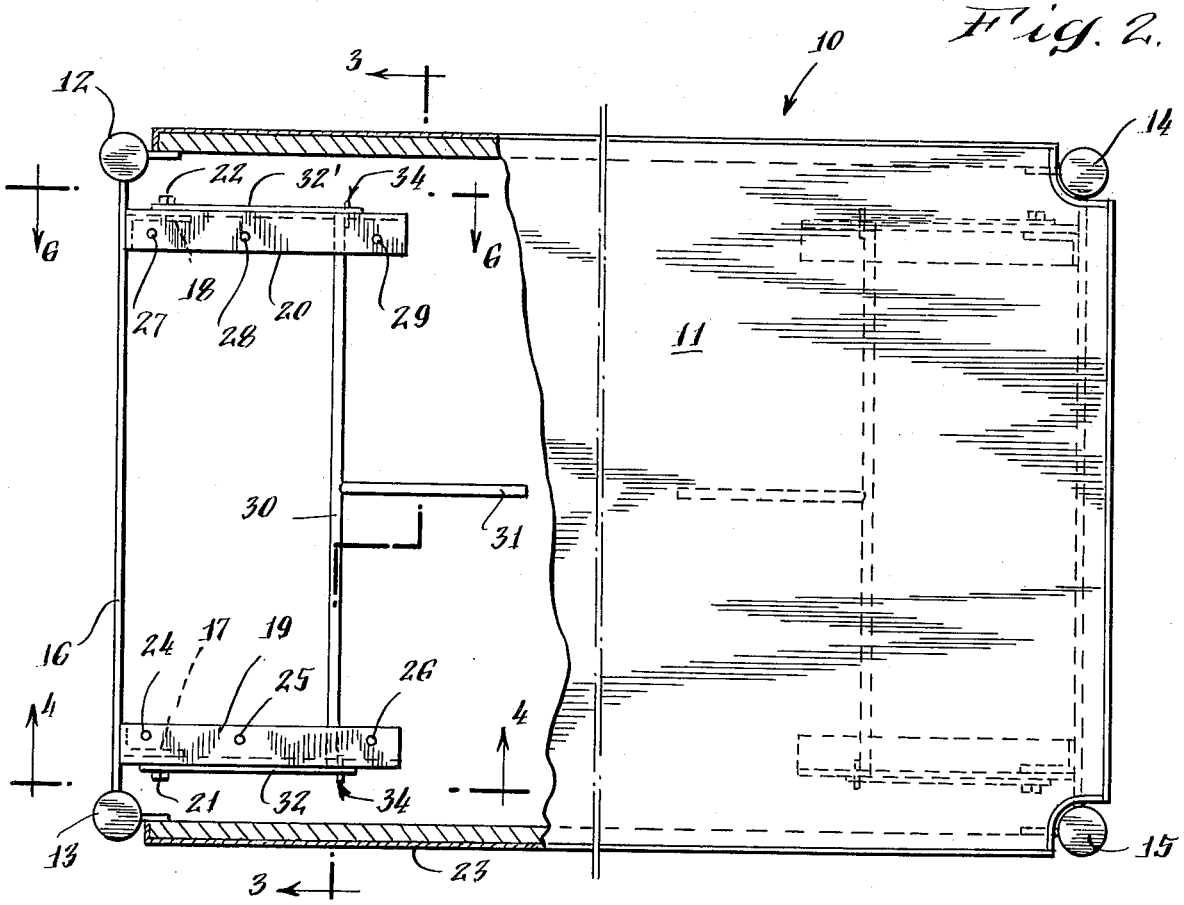
FIG. 2 is a top plan view of the table of FIG. 1, partially broken away to show the leg locking mechanism.

Referring now in greater detail to FIG. 2 of the drawings, the legs 12–13 are rigidly mounted on the opposite ends of a horizontal cross-bar 16 which preferaby is formed of solid metal such as steel. Secured to the inner side surface of cross-bar 16 are a pair of parallel spaced apart hinge brackets 17 and 18, which may be fastened to bar 16 by welding. Hinge brackets 17 and 18 are pivotally mounted to the upright edges of a pair of parallel angle members 19–20 by pivot means 21 and 22 which may be machine bolts. The angle iron members 19 and 20 are fastened to the underside of table top 11 by a suitable number of screws passing through holes such as 24, 25 and 26 shown in angle member 19, and 27, 28 and 29 in angle member 20, in the broken away portion of FIG. 2. Through the opposite ends of angle members 19 an 20 (to the right as viewed in FIG. 2) co-axial bearing holes are pierced in the upright flange portions thereof and a rotatable shaft 30 is mounted. To the center of shaft 30, and extending at right angles thereto, is welded a handle member 31. An eccentric linkage 32 (as shown more clearly in FIG. 4) links the pivotal end 34 of shaft 30 with the pivot 21. A similar eccentric linkage 32' couples end 34' of shaft 30 with pivot 22. Identical mechanism is provided at the opposite end of table 10, as shown in broken lines in the right hand half of FIG. 2.

Figure 3:
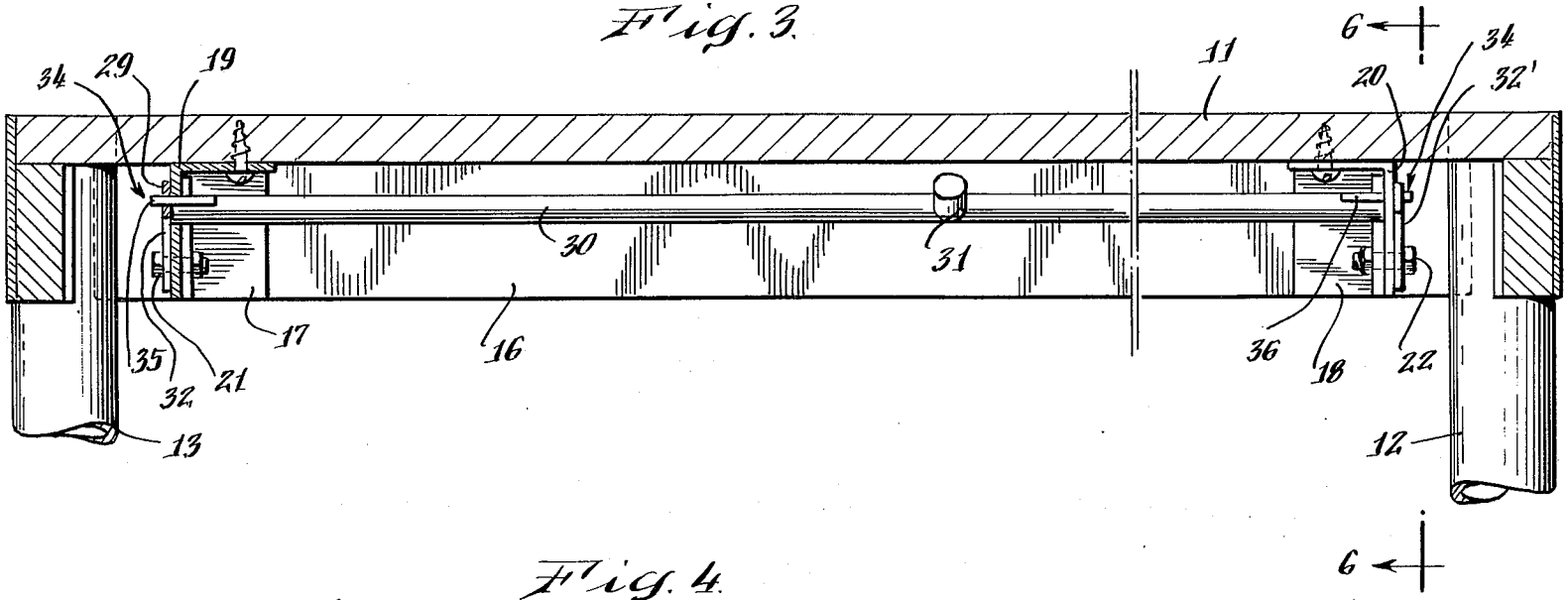
FIG. 3 is an enlarged sectional view taken along the line 3—3 of FIG. 2.
Figure 4:
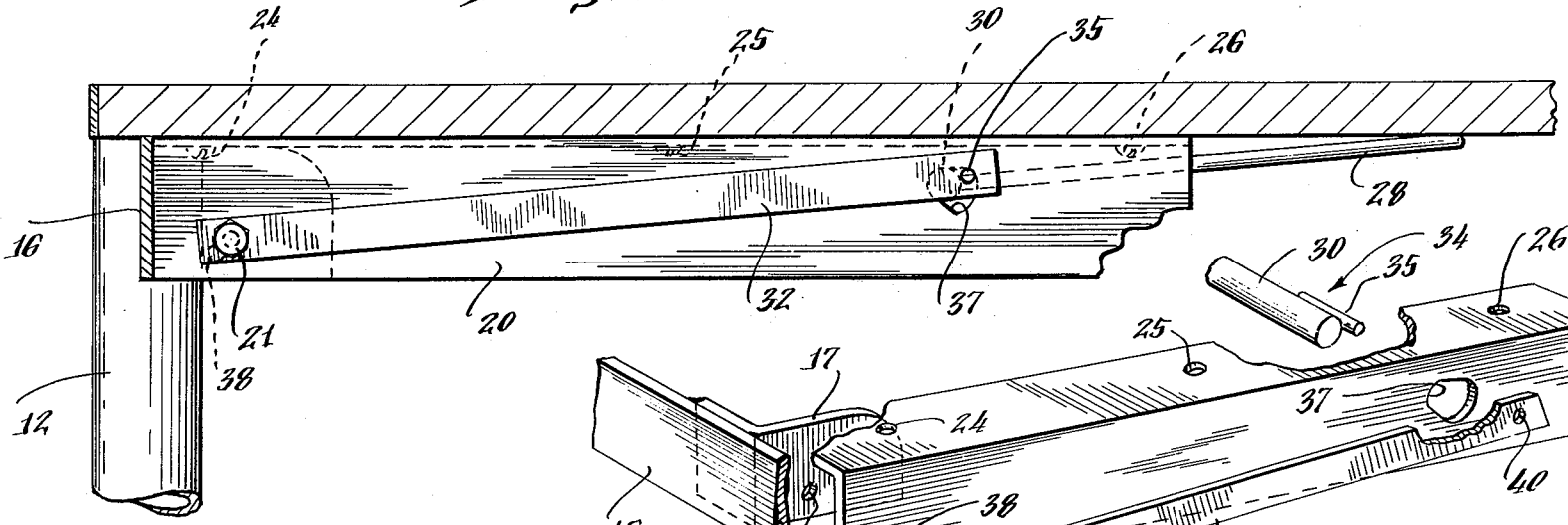
FIG. 4 is a similar enlarged sectional view taken along the line 4—4 of FIG. 2.

Reference is now had to FIG. 3 of the drawings which is a sectional view taken along the line 3—3 of FIG. 2. Here is may be seen that a pair of longitudinal cylindrical pins 35 and 36 are welded to the exterior cylindrical periphery of rotatable shaft 30 at opposite ends thereof to provide eccentric bearing surfaces for the shaft ends which pass through pear shaped bearing holes such as 37 in angle iron bracket 20 as shown in FIG. 4 of the drawings. The preferred shape of bearing hole 37 is more clearly shown in the enlarged perspective view of FIG. 5 of the drawings.

Figure 5:
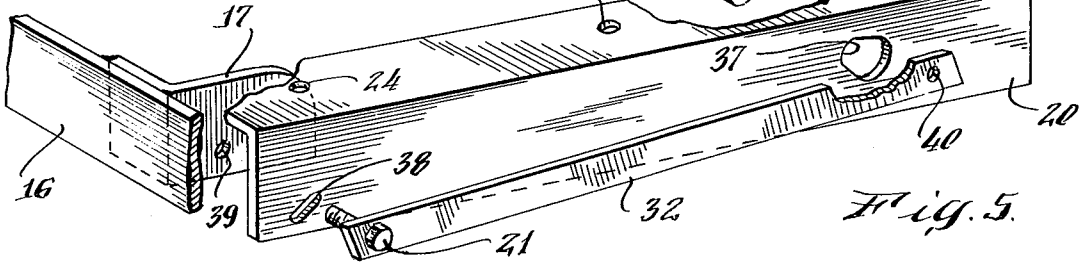
FIG. 5 is an exploded perspective view of the locking mechanism of FIG. 4.

Referring now to FIG. 6 through FIG. 9, wherein the table is inverted and viewed along the line 6—6 of FIG. 2, the sequential steps involved in unlocking the upright table legs, folding the unlocked legs and subsequently locking the folded legs in their folded condition will be described. First in FIG. 6 the table leg 13 is shown in its upright locked position, with the operating handle 31 firmly pressed against the underside of the inverted table top. The pivot pin 22, which corresponds to pivot pin 21 in the opposite end of the mechanism as shown in FIG. 4 and FIG. 5, rides in an elongated slot 38 pierced through the flange of angle iron 20 as shown more clearly in FIG. 5 of the drawings. The pins 21 and 22 pass freely through the oblong slots 38 from opposite linkage arms 32 and 32′ and thence pass through circular bearing holes 39 in hinge brackets 17 and 18 as may be seen clearly from the exploded view of FIG. 5. The pins 21 and 22 are secured to linkage arms 32 and 32′ by welding or brazing and the opposite ends of both pins 21 and 22 are held against removal from bearing holes 39 by suitable fastening means (not shown). At the opposite end of linkage arms 32 and 32′ a bearing hole 40 receives pins 35 and 36 which are passed through pear-shaped cam holes 37. After assembly suitable retaining means (not shown) are affixed to the ends of shafts 35 and 36. In the locked position of the folding mechanism shown in FIG. 6 and FIG. 9 the pivotal centers of pin 22 and shafts 30 and 36 do not lie in a straight line but rather the center of shaft 36 lies below (i.e., closer to the underside of the table top) a straight line drawn through the centers of 22 and 30. This eccentric condition holds the legs 13 (and 12) firmly locked in their existing positions (i.e., either upright as in FIG. 6 or folded as in FIG. 9).

Figures 6, 7, 8, 9:
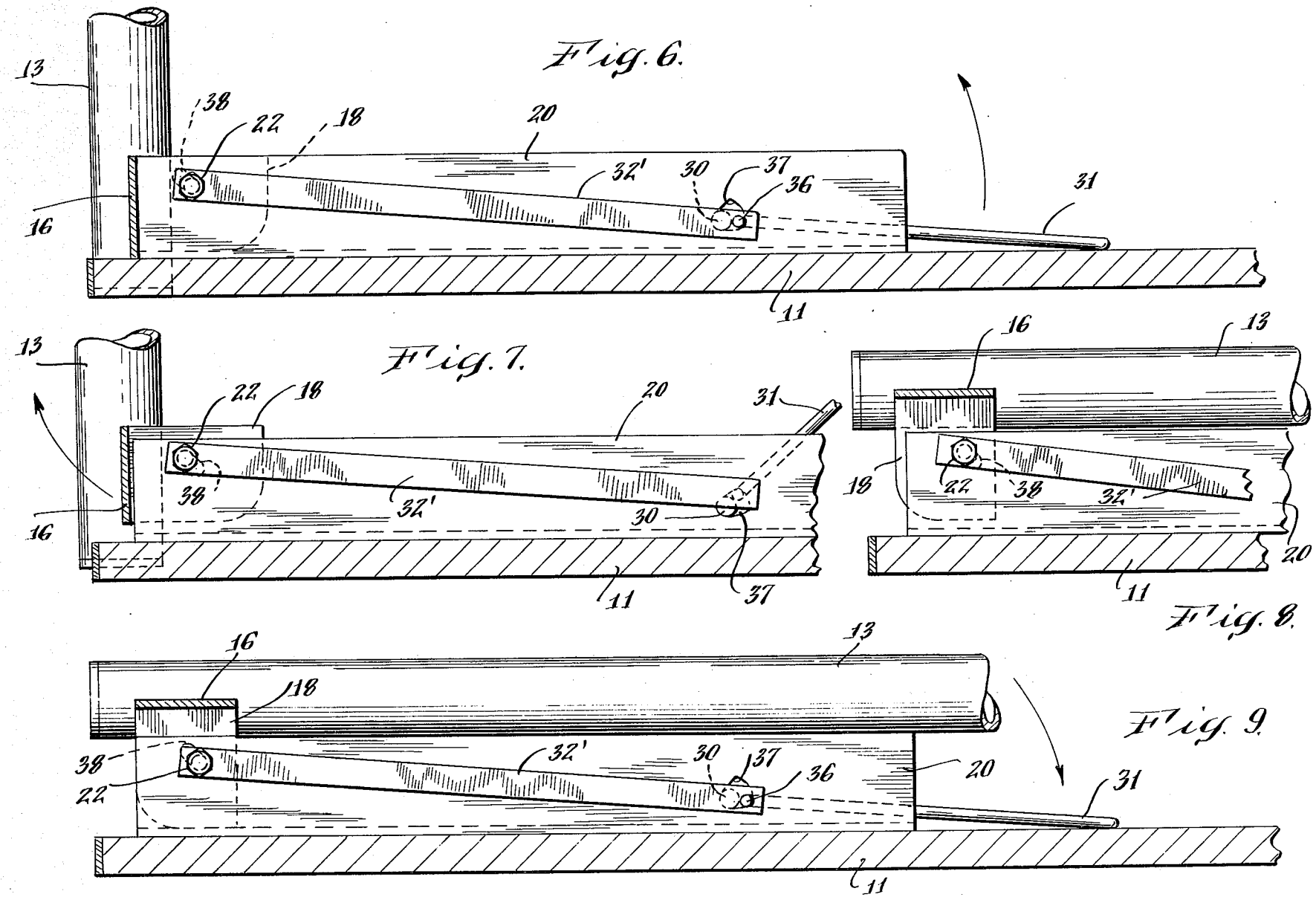
FIG. 6 is a inverted enlarged side view taken along the line 6—6 of FIG. 2.
FIG. 7 is a view similar to FIG. 6 but showing the handle of the locking mechanism raised to its upright position to effect unlocking of the table legs.
FIG. 8 is a view similar to FIG. 7 showing the unlocked table leg folded horizontally parallel to the underside of the table top.
FIG. 9 is a view similar to FIG. 8 showing the table leg locked into its folded position.

Referring now to FIG. 7, when the operating handle 31 is moved away from engagement with the underside of the table top (in the direction shown by the arrow in FIG. 6), the shaft 36 is caused to move counter-clockwise about the axis of shaft 30, within the enlarged camming portion of bearing hole 37, thereby elevating eccentric linkage 32′ and at the same time causing the opposite end to rise upwardly and outwardly in the elongated slot 38. This movement causes leg 13, its connecting cross-bar 16 and integral hinge flange 18 to move in the direction indicated by the arrow in FIG. 7. In this condition the leg 13 (and its companion 12 mounted on the opposite end of cross-bar 16) is unlocked and both legs may be manually folded over about the axis of pin 22 into the horizontal position shown in FIG. 8 of the drawings. In this position (with operating handle 31 still elevated) a slight horizontal space remains between table leg 13 and the outer table edge 23 (FIG. 1 and FIG. 2). When the operating handle 31 is now moved in the direction shown by the arrow in FIG. 9 into firm engagement with the underside of table top 11, the leg 13 is brought into firm engagement against the underside of outer table edge 23, whereby the leg 13 (and its companion 12) are both firmly and securely locked to the underside of the table when folded.

It will thus be seen that the objects set forth above, among those made apparent from the preceeding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention which, as a matter of language, might be said to fall therebetween.

Having described my invention, what I claim as new and desired to secure by Letters Patent is:

1. A folding table leg construction wherein opposed pairs of table legs are alternatively locked in either a rigid upright position or in a secure folded position parallel and adjacent to the underside of the table top comprising in combination, a substantially flat planar table top, a pair of spaced apart parallel metallic angle members secured to the underside of said table top in proximity to opposite edges of said top, a hinge bracket pivotally mounted on one end of each of said angle members and pivotal about a first common axis parallel to the plane of said table top, a rigid cross bar member secured to both of said hinge brackets and extending therebetween parallel to said common pivotal axis, a pair of table supporting legs secured to opposite ends of said cross bar member and normally extending perpendicular to said common pivotal axis, a dual radius pear shaped bearing opening formed through the opposite ends of each of said parallel angle members and establishing a second pivotal axis parallel to said first pivotal axis, an elongated cylindrical shaft having its opposite ends mounted in said bearing openings and pivotal about said second axis, a pair of protruding members secured to opposite ends of said cylindrical shaft and extending beyond the ends thereof through the the large portion of said pear-shaped bearing opening beyond the outer flanges of said angle members, a pair of rigid elongated eccentric arms having one end of each pivotally mounted to said protruding members and the opposite ends of each said arms mounted to pivot means passing through said angle members and said hinge brackets at said first common axis, and handle means mounted on said cylindrical shaft whereby said shaft and its protruding end members may be rotated from a first off-center locking position through dead center in which said shaft, said protruding end members and said first pivotal axis are in alignment, into a second off-center position in which said eccentric arms unlock said table legs for pivotal movement about said first pivotal axis.

2. The combination of claim 1 wherein said first pivot means mounted on said opposite ends of the eccentric arms pass through elongated angularly disposed openings in said angle members to pivotally engage said hinge brackets, whereby when said handle means is moved to rotate said cylindrical shaft from said first off-center locking position through dead center into said second off-center position said pivot means on the opposite ends of said eccentric arms are caused to move through said elongated openings to shift said first pivotal axis in a direction away from the plane of said table top.

3. The combination of claim 2 wherein said elongated openings in said angle members are formed at an angle to the plane of said table top and said openings are of a length slightly greater than twice the diameter of said first pivot means.

4. The combination of claim 1 wherein the first radius of said dual radius bearing opening conforms to the radius of said cylindrical shaft and the second radius thereof substantially equals the sum of said first radius and the diameter of said protruding members.

5. The combination of claim 1 wherein the first radius of said dual radius bearing opening equals the radius of said cylindrical shaft, the second radius thereof is slightly greater than the sum of said first radius and the diameter of said protruding members, said first pivot means on said eccentric arms pass through elongated openings in said angle members, and the length of said elongated openings is at least equal to the second radius of said dual radius bearing.

6. For use in a folding leg table construction, a leg locking mechanism comprising in combination, a leg supporting member having an angle bracket mounted thereon and extending normal thereto, a first pivotal bearing formed in the extending portion of said bracket, a second angle member for mounting on the underside of a table top, an elongated slot formed through one end of said second angle member, an eccenric linkage arm, a first pivot pin member on one end of said arm extending through said elongated slot into pivotal engagement with said first pivotal bearing, a dual radius bearing having a small radius portion and a large radius portion formed in the end of said second angle member remote from said elongated slot, a cylindrical shaft member pivotally mounted in the smaller radius portion of said dual radius bearing, and a second protruding pin member mounted on said cylindrical shaft member and extending through the larger radius portion of said dual radius bearing member into pivotal engagement with the end of said eccentric linkage arm remote from said first pin member.

7. The combination of claim 6 and an extended handle connected to said cylindrical shaft member for imparting pivotal rotation thereto whereby said second protruding pin member is moved about the axis of said cylindrical shaft member within the confines of said dual radius bearing to impart longitudinal motion to said eccentric linkage arm, whereby said first pivot pin member is caused to slide within said elongated slot to displace the pivotal axis of said angle bracket and leg supporting member.

8. The combination of claim 6 wherein said elongated slot is disposed at an angle to the longitudinal edge of said second angle member; whereby movement of said handle form a first off-center locking position through a dead center wherein the axes of said second pin member, said cylindrical shaft member and said first pivot in member are aligned, to a second off-center unlocking position, causes said first pivot member and said angle bracket and leg supporting member to move obliquely into disengagement with said mechanism and any table to which said second angle member may be mounted.

9. The combination of claim 6 wherein the first radius of said dual radius bearing substantially equals the radius of said cylindrical shaft member, the second radius thereof is slightly greater than the sum of said first radius and the diameter of said second protruding pin member, said elongated slot extends at an angle to the longitudinal edge of said second angle member, and the length of said angularly disposed elongated slot is at least equal to the major radius of said dual radius bearing.

* * * * *